US006450835B1

(12) United States Patent
Lee

(10) Patent No.: US 6,450,835 B1
(45) Date of Patent: Sep. 17, 2002

(54) STRUCTURE OF A METAL HOOD HOUSING FOR CONNECTOR

(75) Inventor: Fred Lee, Hsi-Chih (TW)

(73) Assignee: Wieson Electronic Co., Ltd., Taipei (TW)

( * ) Notice: Subject to any disclaimer, the term of this patent is extended or adjusted under 35 U.S.C. 154(b) by 0 days.

(21) Appl. No.: 09/833,690

(22) Filed: Apr. 13, 2001

(51) Int. Cl.[7] ..... H01R 13/648
(52) U.S. Cl. ..... 439/607; 439/901
(58) Field of Search ..... 439/607, 753, 439/870, 901, 905, 906

(56) References Cited

U.S. PATENT DOCUMENTS 6,086,429 A * 7/2000 Wu ..... 439/676
6,213,813 B1 * 4/2001 Huang ..... 439/607
6,224,420 B1 * 5/2001 Nishio et al. ..... 439/566
6,241,555 B1 * 6/2001 Okuyama et al. ..... 439/607
6,280,251 B1 * 8/2001 Nishio et al. ..... 439/607
6,290,540 B1 * 9/2001 Nishio et al. ..... 439/607
6,293,825 B1 * 9/2001 Huang ..... 439/607
6,296,521 B1 * 10/2001 Chang et al. ..... 439/607

* cited by examiner

*Primary Examiner*—P. Austin Bradley
*Assistant Examiner*—Edwin A. León
(74) *Attorney, Agent, or Firm*—Rosenberg, Klein & Lee

(57) ABSTRACT

An improved structure of a metal hood for connector is disclosed, and the hood comprises a top plate portion, side plate portion, bottom plate portion and a rear plate portion. A symmetrical L-shaped extension portion each at the two sides of the rear plate section is externally extended from the corner end of the rear plate portions. In the process of bending formation of the metal hood, the two L-shaped extension portions are exactly formed into vertically downward ground terminals of the metal hood. As the ground terminal of the housing is located at the rear plate portion of the metal hood, the method of feed-strap of plating can be employed in the process of selective plating, hence, avoiding color change of the housing as a result of proximity to a hear source.

1 Claim, 4 Drawing Sheets

STRUCTURE OF A METAL HOOD HOUSING FOR CONNECTOR

BACKGROUND OF THE INVENTION (a) Field of the Invention

The present invention relates to an improved structure of a metal hood housing for connector, and in particular, a housing with ground terminals being formed integrally on the rear plate portions of the housing. By using the method of feed-strap in the process of tin-plating, the selective-plating process is simplified and defect products are greatly reduced, and the quality of the metal hood for the connector is improved.

(b) Description of the Prior Art

Connectors are widely used in connection of various power source and signals so as to provide conduction and communication. Recently, as a result of rapid development of computers and the peripherals thereof, connectors with various shapes are exploited, but their fundamental shapes are that there are two corresponding head ends connecting with each other such that the internal electrical contacts of the connectors are in contact and formed into the basic configuration for conduction.

In order to improve the communication quality, and to upgrade transmission rate, the signal wires, adjacent to each other, of all connectors are isolated from each other so as to ensure proper insulation and thus, cross talk is avoided. Generally, a metal hood housing is used to cover the external of the connector such that the housing is in conduction with a common ground terminal.

As shown in FIG. 1, there is shown a hood housing 10 for a typical IEEE 1394 connector. The housing 10 being exploded is shown in FIG. 2 The housing 10 comprises a top plate portion 11, two side plate portions 12, 13, two bottom plate portions 14, 15, and rear plate portion 16 and being formed into a hollow housing by bending along a plurality of bending lines 18 provided thereon. An elastic press button 17 is located on the top plate portion 11 and the two bottom plate portions 14, 15. At the external end of the two side plated portions 12, 13, an extension portion 19 is extended externally therefrom and the extension portion 19 are symmetrical. When the housing 10 is formed, the two extension portions 19 are vertically faced downward from the two sides of the housing 10 to form into the ground terminal of the housing 10, as shown in FIG. 1.

In view of the conventional housing 10, the ground terminals are formed integrally with the metal hood 10, and after the housing is extended in a plan view, the two ground terminals are respectively located at the two sides of the housing 10. Thus, it is inconvenient to fabricate such structure, and additionally, the two ground terminals are too close to the housing, and therefore the tin-plating process is difficult to apply to the housing and the housing can be easily become yellow or the color can be changed easily. Thus, defect products in the course of fabrication may be formed, and the process of fabrication is complicated.

SUMMARY OF THE INVENTION

Accordingly, it is an object of the present invention to provide an improved structure of a metal hood housing for connector, which can mitigate the above mentioned drawbacks. The present invention simplifies the manufacturing process of tin-plating on the housing so as to reduce defect product and improve the quality of the metal hood for connector.

Yet another object of the present invention to provide an improved structure of a metal hood housing for connector, wherein the ground terminals of the metal hood are formed integrally at the rear plate portions of the hood housing so as to simplify manufacturing process of tin plating.

A further object of the present invention to provide an improved structure of a metal hood housing for connector is disclosed, and the hood comprises a top plate portion, side plate portions, a bottom plate portion and a rear plate portion.

Another object of the present invention to provide an improved structure of a metal hood housing for connector, wherein no additional fabrication is needed in simplifying the selective plating process of the ground terminals so as to reduce defect products.

Other object and advantages of the present invention will become more apparent from the following description taken in conjunction with the accompanying drawing.

DETAILED DESCRIPTION OF THE PRESENT INVENTION

Figure 1:
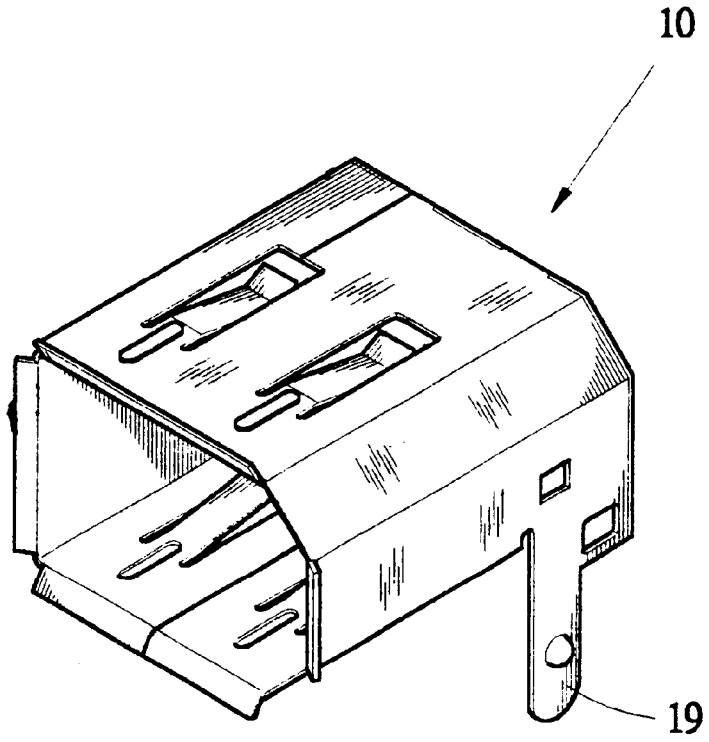
FIG.1 PRIOR ART
FIG. 1 is a perspective view of a conventional metal hood housing for a connector.
Figure 2:
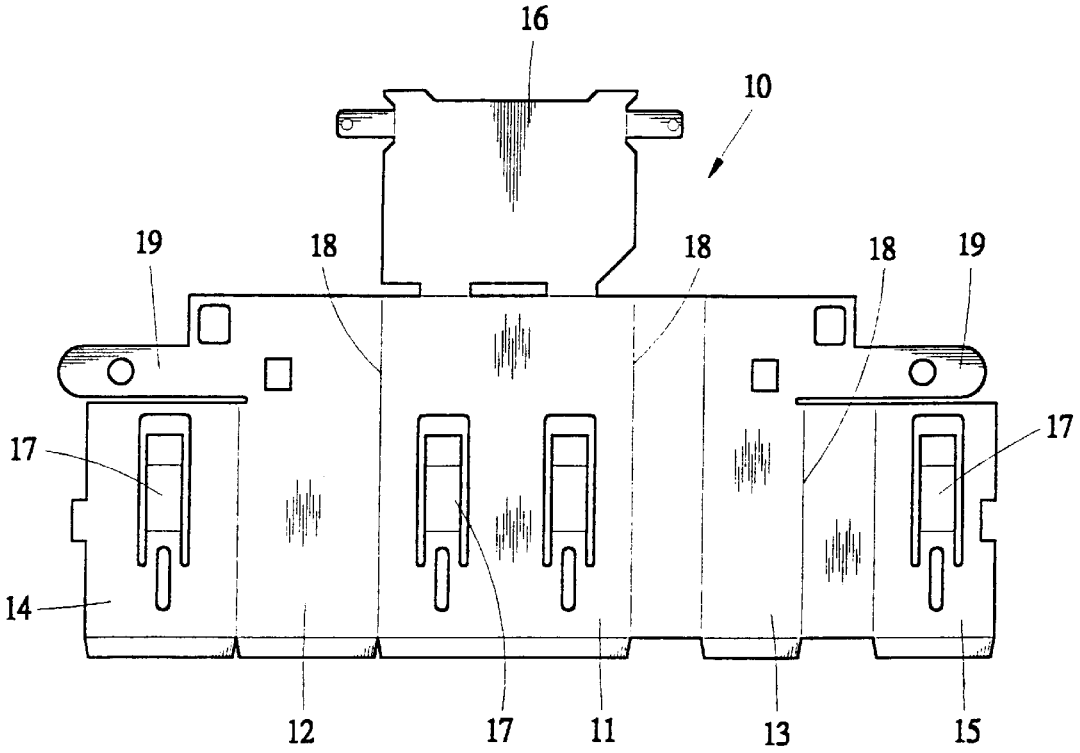
FIG.2 PRIOR ART
FIG. 2 is an extension view of the housing shown in FIG. 1.
Figure 3:
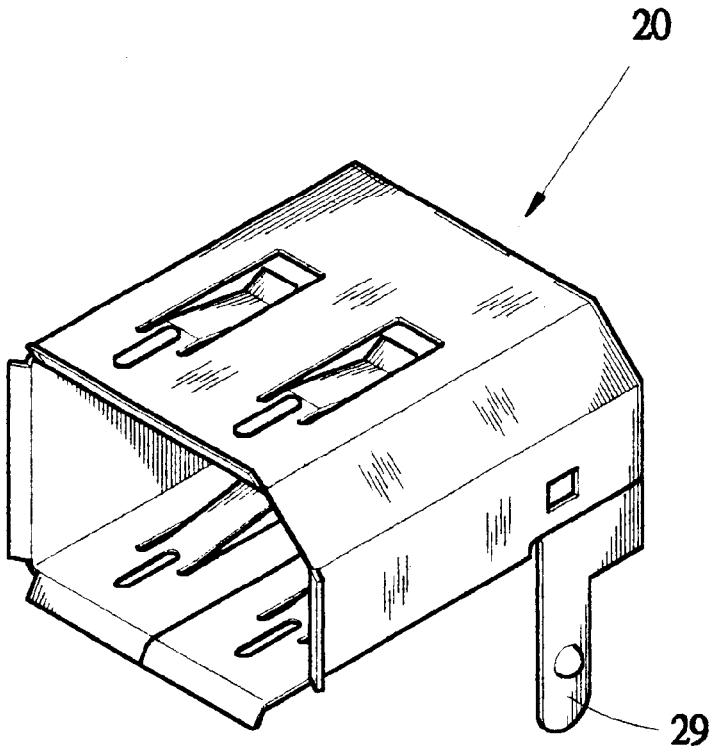
FIG. 3 is a perspective view of a metal hood housing for a connector in accordance with the present invention.
Figure 4:
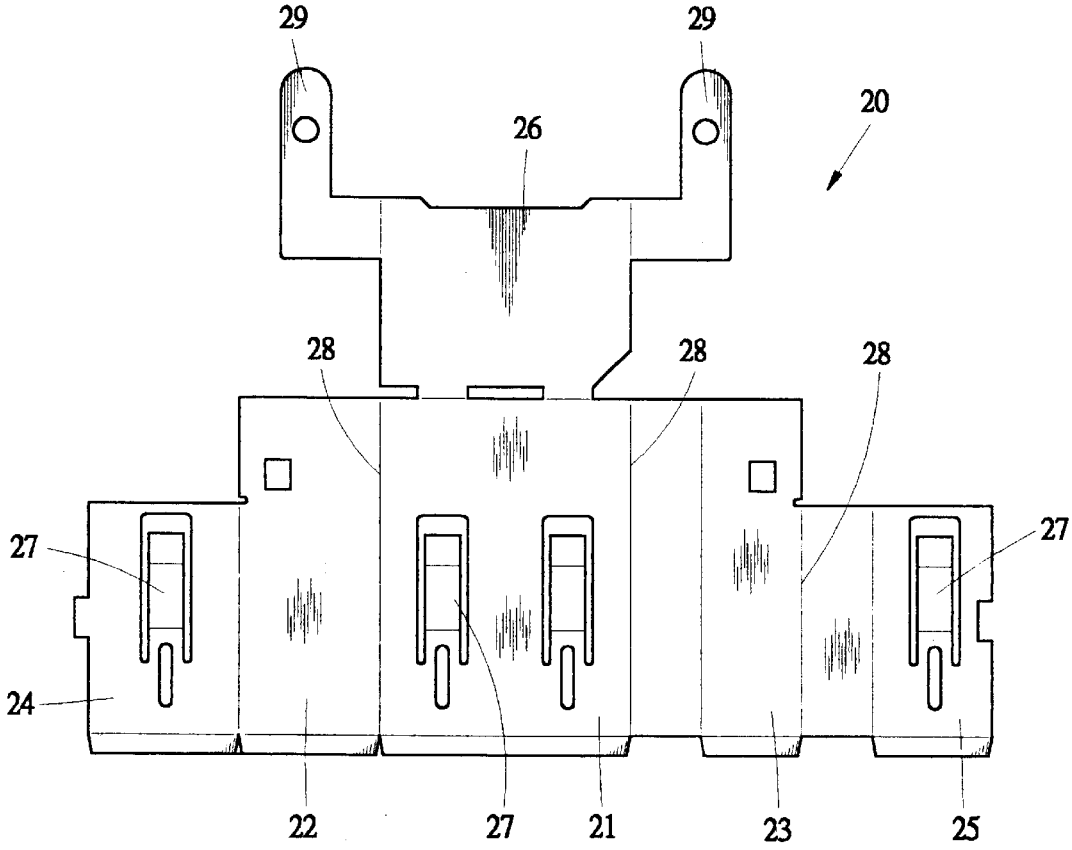
FIG. 4 is an extension view of the housing of the metal hood of the present invention.

Referring to FIGS. 3 and 4, the metal hood housing 20 for the connector (prior to bending formation) is a hollow housing and the entire housing comprises a top plate portion 21, side plate portions 22, 23, bottom plate portions 24, 25 and a rear plate portion 26. As shown in FIG. 4, on the metal hood housing 20, a plurality of bending lines 28 are respectively provided between the top plate portion 21 and the two side plate portions 22, 23, between the top plate portion 21 and the rear plate portion 26, and between the two side plate portions 22, 23, and the two bottom plate portions 24, 25. This allows the bending formation along the bending lines 28 to form a hollow metal hood housing 20.

On the metal hood housing 20 including the top plate portion 21 and the two bottom plate portions 24, 25, there is an elastic press button 27 respectively located thereon, such that when the metal hood housing is bent and covered the connector, they are used as clipping fastener for the plug head of the connector.

On the metal hood housing 20, a symmetrical L-shaped extension portion 29, at the two sides of the rear plate section 26 is externally extended from the corner end of the rear plate portions 26, and the two L-shaped extension portions 29 are extended to the outermost of the housing 20 of the metal hood such that during the bending formation of the metal hood, the two L-shaped extension portions 29 are exactly formed into vertically downward ground terminals of the metal hood, as shown in FIG. 3.

In accordance with the present invention, before the housing 20 is bent, there is a distance between the L-shaped extension portion 29 and the top plate portion 21, the side plate portions 22, 23, the bottom plate portions 24, 25, thus, feed-strap method of selective plating can be employed so as to proceed with the tin-plating of the two ground terminals without affecting the metal hood housing, and the number of the defect products are reduced.

In application, as the manufacturing process of the present invention is similar to that of the conventional art, therefore, additional fabrication process is not needed.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

What is claimed is:

1. A metal hood for a connector comprising a one piece metal blank, said one piece metal blank including:

a centrally disposed upper wall panel;

a pair of side wall panels each having a first side respectively connected to opposing sides of said upper wall panel by a pair of corresponding first fold lines;

a pair of bottom panels each being connected to a second side of a respective one of said pair of side wall panels by a corresponding second fold line, said pair of bottom panels together forming a bottom wall of said metal hood subsequent to folding said pair of bottom panels downwardly along said second fold lines and downward folding of said pair of side wall panels along said first fold lines;

a rear wall panel connected to a rear edge of said upper wall panel by a third fold line; and, a pair of L-shaped extensions connected to respective portions of opposing sides of said rear wall panel by corresponding fourth fold lines, each of said L-shaped extensions being formed by a longitudinally extended first leg and an orthogonally directed second leg, said first leg being longer than said second leg and said second leg being connected to said rear wall panel at a distal end thereof, said pair of L-shaped extensions forming a respective pair of grounding terminals subsequent to folding said L-shaped extensions downwardly along said fourth fold lines and downward folding of said rear wall panel along said third fold line, wherein each of said second legs extend substantially parallel to a respective folded side wall panel and each said first legs extend downwardly therefrom.

* * * * *